US005601128A

United States Patent [19]

Furphy

[11] Patent Number: 5,601,128

[45] Date of Patent: Feb. 11, 1997

[54] AMPULE BREAKING METHOD AND APPARATUS

[76] Inventor: Charles F. Furphy, 2136 Via Teca St., San Clemente, Calif. 92673

[21] Appl. No.: 523,587

[22] Filed: Sep. 5, 1995

[51] Int. Cl.[6] ..... B65D 83/00

[52] U.S. Cl. ..... 141/98; 141/1; 141/2; 141/18; 141/319; 241/99; 241/606; 225/93; 225/96.5; 225/97; 225/103; 422/104

[58] Field of Search ..... 141/1, 18, 21, 141/97, 250, 391, 319, 320, 329, 330, 98; 222/81–88, 136; 241/99, 101.2, 101.5, 606; 225/93, 96.5, 97, 103; 422/102, 104; 604/200

[56] References Cited

U.S. PATENT DOCUMENTS

| | | | |
|---|---|---|---|
| 806,819 | 12/1905 | Mattson | 422/104 X |
| 1,088,642 | 2/1914 | Wilcox | 422/104 X |
| 1,103,111 | 7/1914 | Wachter | 241/99 X |
| 2,515,020 | 7/1950 | Scott | 30/164.9 |
| 3,380,636 | 4/1968 | Ushkow et al. | 225/103 |
| 4,159,568 | 7/1979 | Berner | 225/103 X |
| 4,417,679 | 11/1983 | Shields | 225/93 |
| 4,508,250 | 4/1985 | Punchak | 225/97 |
| 4,570,838 | 2/1986 | Szemere et al. | 225/93 |
| 4,637,139 | 1/1987 | Chen | 30/164.9 |
| 4,805,821 | 2/1989 | Kowalczyk et al. | 225/96.5 |
| 5,133,939 | 7/1992 | Mahe | 422/104 |

FOREIGN PATENT DOCUMENTS

| | | | |
|---|---|---|---|
| 557610 | 2/1957 | Italy | 225/93 |

*Primary Examiner*—J. Casimer Jacyna
*Attorney, Agent, or Firm*—Gordon K. Anderson

[57] ABSTRACT

A sterile method of simultaneously breaking a number of ampules (22) containing medication and transferring the liquid drug into syringes (58), which include cutting the ampule shipping container (20) in half and enclosing the ampules in a holder (26). Further, cleaning the ampules and breaking the ampule necks (30) with a shear plate (40) struck by a mallet (44). Finally, transferring the medication with a filtered needle (50) to a sterile container (56) and filling the syringes from the container. The method utilizes apparatus which has a holder (26) of the same configuration as the shipping container (20) and a shear plate (40) that fits over the ampule necks (30). The mallet (44) is used to strike the shear plate breaking all of the necks simultaneously. A tray (34) collects the necks and debris and a sweep (46) clears the debris away into a bio-hazard container (62), or the like.

14 Claims, 4 Drawing Sheets

AMPULE BREAKING METHOD AND APPARATUS

TECHNICAL FIELD

The present invention relates to a method and apparatus for opening a number of glass ampules simultaneously in general. More specifically, to a method of transferring liquid medication from a plurality of sealed ampules into syringes under aseptic conditions using a tray containing an ampule holder with a shear plate, mallet, and accessories.

BACKGROUND ART

Previously, many types of manual and automatic ampule openers have been used in endeavoring to provide an effective means for producing a safe and clean method of opening medication containing ampules. Medical injection liquid medication is commonly stored in an ampule and is broken open when the dose is to be transferred to a syringe and injected into the patient. The ampule is made of thin glass and has a narrow neck and may have a cutting line etched into this neck portion between the head and the body. This feature allows the neck to be manually snapped off, exposing the liquid inside, ready for drawing into a syringe. Since the ampule is broken open by hand, sometimes the break line is sharp and uneven and may cut or injure the medical practitioner. Prior art has approached this problem by developing hand held devices that grasp the neck and break the ampule by depressing a plunger or simply. axially bending the retained neck until it breaks. Others grasp the body and score the neck prior to snapping off the head. A different precept utilize robotics with pneumatic rotary actuators that knock the head off at the neck or manually break the neck in a flexible enclosure and vacuum the debris away.

A search of the prior art did not disclose any patents that read directly on the claims of the instant invention, however, the following U.S. patents are considered related:

| U.S. Pat. No. | Inventor | Issue Date |
|---|---|---|
| 4,805,821 | Kowalczyk et al | Feb. 21, 1989 |
| 4,637,139 | Chen | Jan. 20, 1987 |
| 4,570,838 | Szemere et al | Feb. 18, 1986 |
| 4,417,679 | Shields | Nov. 29, 1983 |
| 2,515,020 | Scott | Jul. 11, 1950 |

Kowalczyk et al in U.S. Pat. No. 4,805,821 teach an automatic ampule opener for use in an automatic robotic sterility testing system. The opener includes a support plate, a knife edge mounted on the support plate and a pneumatically rotated arm that revolves and strikes the head of the ampule, which is rested on the knife edge, breaking it at the neck. The ampule is placed in the device by robotics and opened for testing the sterility of the contents within a clean room environment.

U.S. Pat. No. 4,637,139 of Chen is directed to a single manual cutter that includes a pair of shells into which an ampule is inserted. One of the shells is pivotally spring loaded. When the ampule is inserted in the cutter, it is then rotated a half of a turn, scoring the neck with a V-shaped blade. Cushioning means formed from molded resilient material hold the head and the tip is broken away from the body with a "snap-action". Releasing the clamping pressure allows the shells to separate such that the spent tip may be removed.

Szemere et al U.S. Pat. No. 4,570,838 discloses an elongated flat body with a ceramic neck scorer affixed to a longitudinal ledge. The body contains a row of different sized holes to accommodate heads of various sized ampules. The head is inserted in the appropriate hole and rotated against the ledge scoring the neck and then snapping off the head with a bending action.

U.S. Pat. No. 4,417,679 issued to Shields includes an annular flexible jacket having a cylindrical opening in one end for receiving the neck of an ampule. The jacket has holes in the periphery and the closed end contains a vacuum tube attached to an external vacuum source. The ampule is inserted into the jacket and then bent until it snaps the neck apart with the particles of glass created from the breakage inspired with the air stream into the filtered vacuum source.

Scott in U.S. Pat. No. 2,515,020 utilizes a crystal of bort riding under the influence of a soft spring that engages the sharp point of the angular bort. The ampule is inserted into the spring loaded cutting edge and rotated a full turn scoring the neck. The ampule is then removed and inserted in an appropriate hole in the opener body and with a tipping motion snapping the neck at the scored mark.

DISCLOSURE OF THE INVENTION

While the invention is not restricted in its use to its initial purpose, the method and apparatus was nonetheless developed to fill a need created by a combination of utility and government regulation for the safety of the public in the pharmaceutical field. Some time ago a new use was found for the medication terbutaline sulfate which is conventionally used for treating asmatics. When applied to pregnant women, the medication stops the uteral contractions of pre-term labor. This treatment has been developed to include the use of a monitor that may be used in the home by strapping it around the patient, allowing stored signals to be periodically sent via telephone to a medical practitioner for evaluation. The optimum amount of medication in this application is three milliliters of terbutaline sulfate per dose, however, since the treatment for asmatics uses one milliliter, this ampule size has exclusively been approved by the Federal Food and Drug Administration. Since approval for the larger size takes a considerable amount of time and is very costly, the industry has accepted the inconvenience to reap the benefits of the present treatment.

Previously, this method of dosage necessitated the pharmacist or medical practitioner to break three, one-milliliter ampules and fill the larger syringe, which is obviously labor intensive and adds to the risk of contamination. It is, therefore, a primary object of the invention to fill the need providing a method and apparatus for simultaneously breaking a large number of ampules and filling larger syringes under aseptic conditions.

An important object of the invention is directed to the method that utilizes a clean room to fulfill the sanitized requirements, also the physical equipment to quickly and easily open the ampules and transfer the medication. The use of class 10,000 aseptic conditions and the actual transfer under a class 100 hood fulfills these requirements. Further, trained personnel, including registered technicians and licensed pharmacists, actually perform and supervise the steps of the method, thus eliminating any possibility of contamination.

Another object of the invention is the safety in which the ampules are opened. Anytime glass is broken it may shatter sending small shards of razor sharp glass that may hit someone and cause damage. Further, when an ampule is broken, the neck is not necessarily smooth and may easily cut the practitioners glove, breaking the barrier, causing at least a time consuming rescrub, if not an injury. The instant invention retains the ampules in a holder and a shear plate is placed on top of the ampule necks. The shear plate is struck with a mallet breaking all of the necks simultaneously. The shear plate protects the operator from flying glass, and since the ampules are contained within the holder, there is no need to handle or touch them at all at any point in the process.

Still another object of the invention is the speed in which the entire process may be accomplished. The ampules are shipped in a sectionized cardboard shipping container, usually 100 at a time. The container is turned upside down and cut around the middle. Removing the cut portion exposes the bottom half of the ampules and a holder having mating holes is placed over the top and inverted, uncovering the necks when the remaining container is removed. The ampules are all cleaned in concert with alcohol to remove any cardboard dust, and then a number of cleaned holders are taken to the clean room where they are placed under a hood. A holder is positioned on a tray and a shear plate is placed over the necks and struck with a mallet, breaking the necks simultaneously. The liquid medication is pumped out of each ampule into a sterile container using a filtered needle where it is transferred to individual syringes. It may easily be seen that 100 ampules are handled as a group in each sequence, therefore the time consumed for the process is reduced to an absolute minimum while still maintaining the sterile integrity.

Yet another object of the invention has to do with the ease of disposal of the ampules and necks. The empty ampules may be deposited into a bio-hazard container by simply turning the holder upside down. Further, the necks and debris are easily swept into the container from the tray, again with no individual handling necessary.

A further object of the invention is the ease of cleaning of the equipment. The holder is thermoplastic with stainless steel posts and pillars and drain holes, also a space between the base and body facilitate access. The tray utilizes a plastic bottom with aluminum angle sides and synthetic rubber feet. The tray is assembled with stainless steel fasteners and the entire tray may be easily dissembled on occasion, if necessary. The mallet is plastic and the handle is pressed into the head with no adhesive used. All of the ampule breaking apparatus has been carefully designed to eliminate contamination by oxidation, or by the use of a chemical adhesive that may out-gas, or in some way effect the septicity.

A final object of the invention has to do with its ability to be used in other applications. While the invention was primarily conceived for a specific purpose by simply changing physical size and hole spacing, the apparatus and/or method may be altered to handle larger or smaller ampules. Further, the method may be applied to other medications requiring transfer from ampules to syringes.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 8:
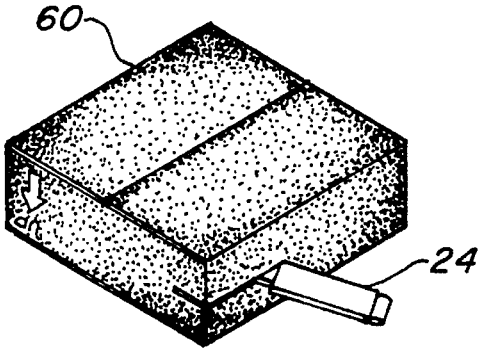
FIG. 8 is a partial isometric view of a ampule shipping container being cut in half.
Figure 9:
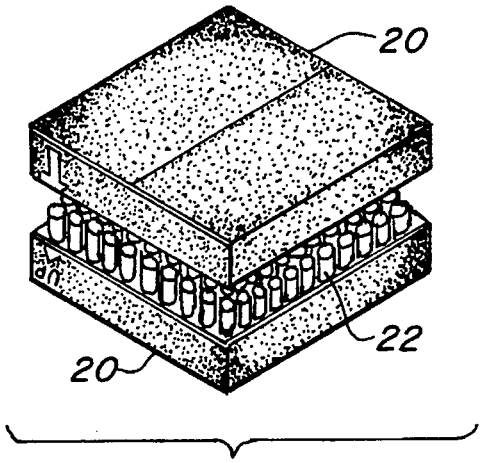
FIG. 9 is a partial isometric view of a shipping container with the top half being removed.

The best mode for carrying out the invention is presented in terms of a preferred embodiment. The preferred embodiment, as shown in FIGS. 1 through 19 is comprised of a method and apparatus for simultaneously breaking a number of ampules and transferring the medication enclosed therein into syringes. The method for conducting this operation consists of a number of sequential steps that include the following:

The first step is cutting an inverted shipping container 20 full of ampules 22 in half, exposing the ampule bottoms. Medication containing ampules 22 are normally shipped in a sectionalized cardboard container 20 many times in the specific quantity of 100 pieces. This step of cutting the container starts by inverting the container, as illustrated in FIG. 8, and cutting with a knife 24 or other sharp implement around the periphery ½ to ⅓ down from the top, and then removing the cut portion, shown in FIG. 9, leaving the ampule bottoms uncovered, making sure the bottoms are all level.

Figure 10:
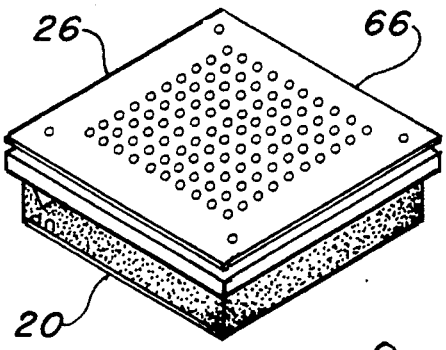
FIG. 10 is a partial isometric view of a holder placed on top of the exposed ampules in the remaining container.

The second step is enclosing the ampule bottoms with a holder 26 that has been rotated upside down. This step is depicted in FIG. 10 and utilizes a holder 26 that has the same number of bores 28 in the same relative position as the shipping container 20. This holder 26 simply slips over all of the ampule bottoms simultaneously, as each bore 28 is slightly larger in diameter than the ampule 22.

Figure 11:
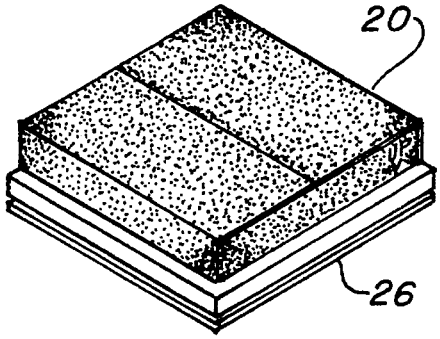
FIG. 11 is a partial isometric view of a holder and remaining shipping container inverted.

The third step is inverting the holder 26 and ampules 22 together with the container half, as shown in FIG. 11, and then discarding the remaining portion of the shipping container 20, again, making sure all of the ampules are level. This action places the ampule necks 30 upright, level, and accessible.

Figure 12:
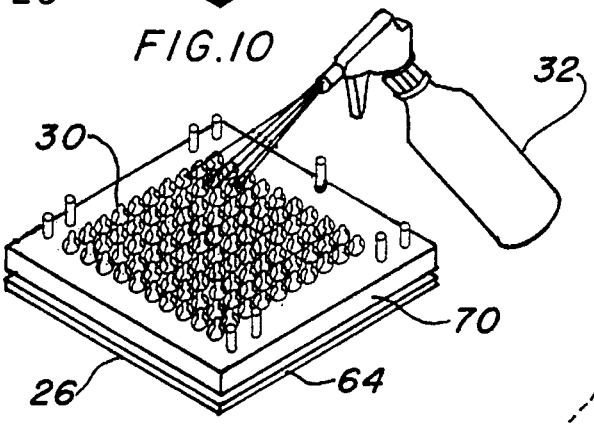
FIG. 12 is a partial isometric view of a shipping container removed, exposing the ampule necks and being cleaned by alcohol in a spray bottle.

The fourth step cleans the ampules 22 that are positioned within the holder 26 with alcohol from a spray bottle 32, as illustrated in FIG. 12. The alcohol under pressure of the spray bottle 32 impinges on the ampules 22 removing any cardboard dust that may be present.

Figure 13:
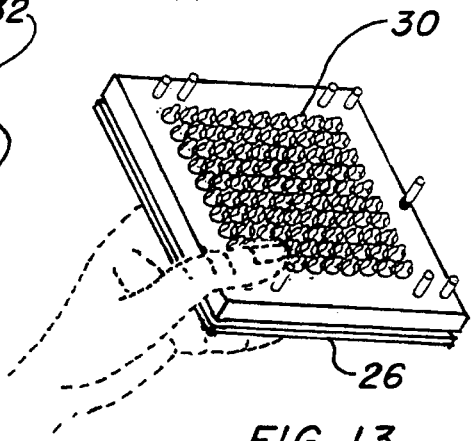
FIG. 13 is a partial isometric view of the ampules within the holder being manually tapped down, to remove medication in the ampule necks.

The fifth step includes tapping down the medication from the ampule necks 30 by hand, as shown in FIG. 13. This action removes any liquid from the necks, thus preventing loss when the ampules 22 are opened.

It will be noted that the above steps are preferably conducted in an ante-room, as cardboard is normally not permitted in a clean room environment due to its fibrous material composition.

Figure 14:
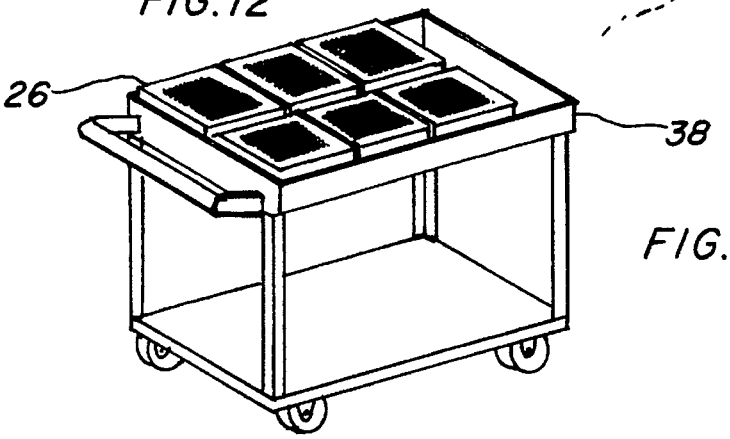
FIG. 14 is a partial isometric view of a clean cart for transporting six holders from an ante-room into a clean room.

The sixth step positions the holder 26 on a tray 34 under a clean room hood 36. The most time efficient procedure is to clean six or eight holders 26 at one time and place them on a cart 38, as illustrated in FIG. 14, and then take the cart into the clean room. It is then easy to place holder 26 on the tray 34 under the hood 36, as depicted in FIG. 15.

Figure 15:
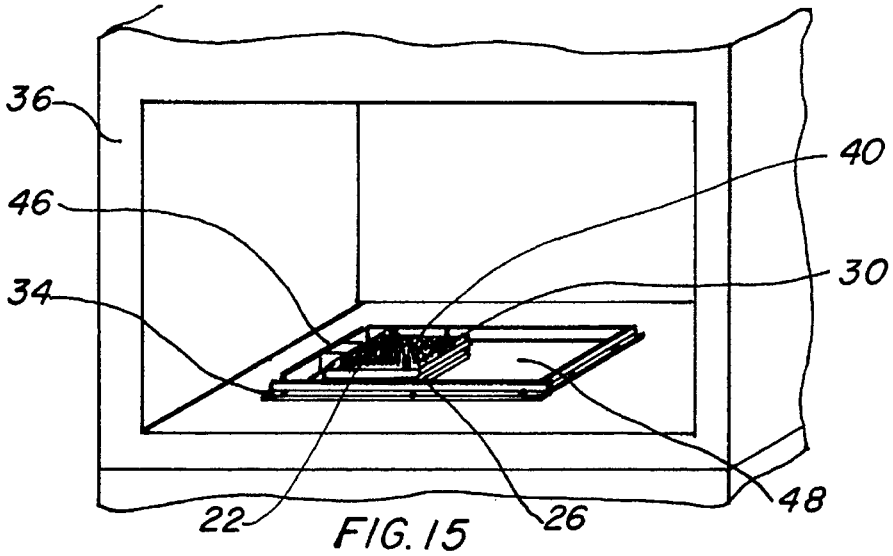
FIG. 15 is a partial isometric view of a clean room hood in which a tray, sweep, and ampule containing holder have been placed.

The seventh step positions a shear plate 40 over the ampule necks 30, as again depicted in FIG. 15. The shear plate 40 has neck receiving holes 42 on the same center to center spacing as the holder 26 and are sized just slightly larger allowing a tight clearance fit.

Figure 3:
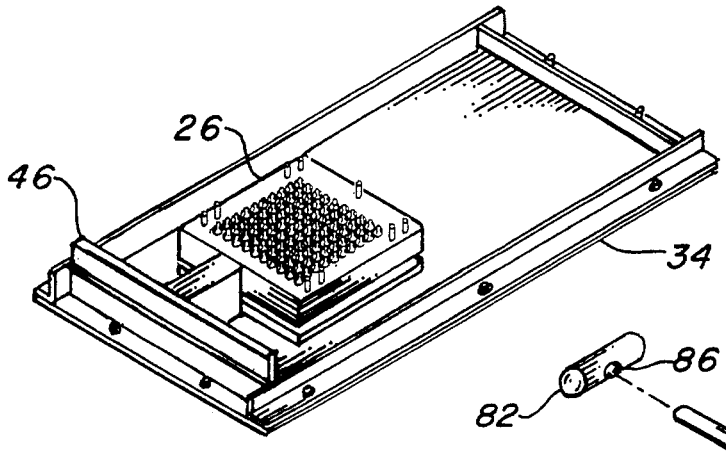
FIG. 3 is a partial isometric view of the ampule holder and shear plate resting against the sweep on the bottom of the tray.
Figure 16:
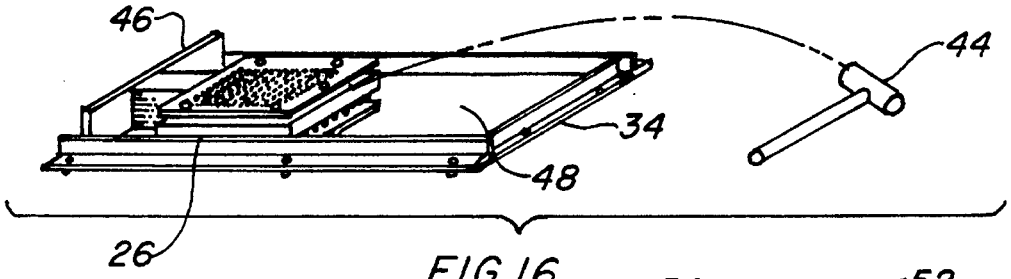
FIG. 16 is a partial isometric exploded view of the mallet striking the shear place to break the ampule necks completely removed from the invention for clarity.

The eighth step is to tap the shear plate 40 with a mallet 44 which simultaneously breaks the ampule necks 30, as illustrated in FIG. 16. It has been found that positioning the holder 26 in the middle of the tray with one edge contiguous with a T-shaped sweep 46, as shown in FIG. 3, functions best, as all of the debris is contained in a single area within the tray bottom 48. Further, it should be noted that a single sharp blow to the exposed edge of the plate 40 is all that is necessary to shear all of the necks simultaneously. As the plate 40 fits the necks closely they are retained in the holes 42 and any shards or other debris is contained between the plate 40 and the holder 26, thus protecting the practitioner.

The ninth step removes the shear plate 40 letting the ampule necks 30 fall onto the tray 34 out of the way. It may be necessary to raise and tip the holder 26 momentarily with one hand to permit the debris to fall free of the holder. This debris is then pushed to the opposite end of the tray with the sweep 46.

Figure 17:
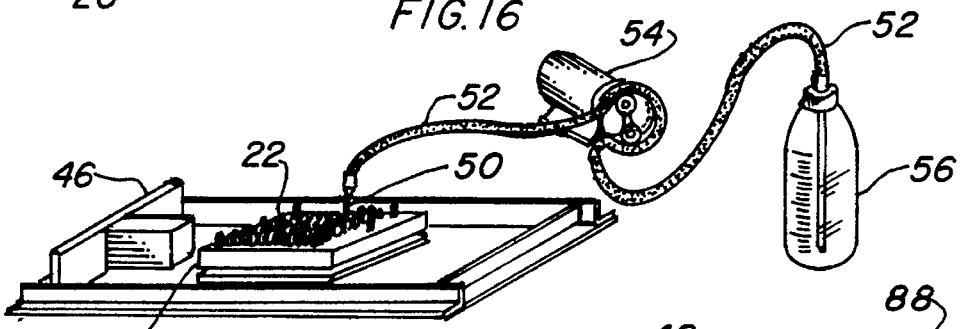
FIG. 17 is a partial isometric view of the medication being transferred from an ampule to a sterile container.

The tenth step is illustrated in FIG. 17 and transfers the medication within each ampule 22 using a filtered needle 50 through hoses 52 and a pump 54 into an evacuated sterile container 56. The pump is preferably the medical peristaltic type and the container a 1 liter (1000 ml) bottle. It may also be necessary to place the holder 26 at a slight angle, as shown in FIG. 17, to be able to reach all of the liquid medication at the bottom of each ampule 22.

Figure 18:
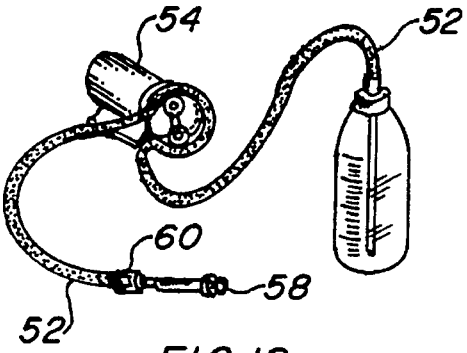
FIG. 18 is a partial isometric view of the syringe being filled from the sterile container.

The eleventh step fills the syringes 58 with medication from the container 56 by reversing the pumps 54 rotation and a fitting 60, preferably in the form of a so-called LUER LOCK, that is affixed to the end of the hose 52. The syringe 58 is inserted into the fitting and filled with medication, as shown in FIG. 18.

Figure 19:
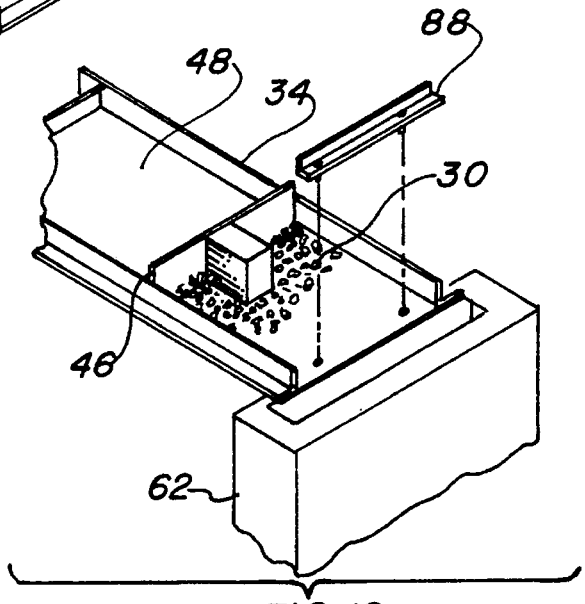
FIG. 19 is a partial isometric exploded view of the broken ampule necks and debris being swept into a bio-hazard container.

The final step is accomplished in the method by sweeping the broken ampule necks 30 and other debris into a biohazard container 62 normally found in a medical clean room environment. This step is illustrated in FIG. 19 with the removable tray side lifted out of the way to facilitate sweeping the glass into the container 62.

It will be clearly seen that the method accomplishes the purpose with ease and dispatch using special apparatus along with equipment normally found in a conventional clean room that has been certified for class 10,000 aseptic conditions.

Figure 1:
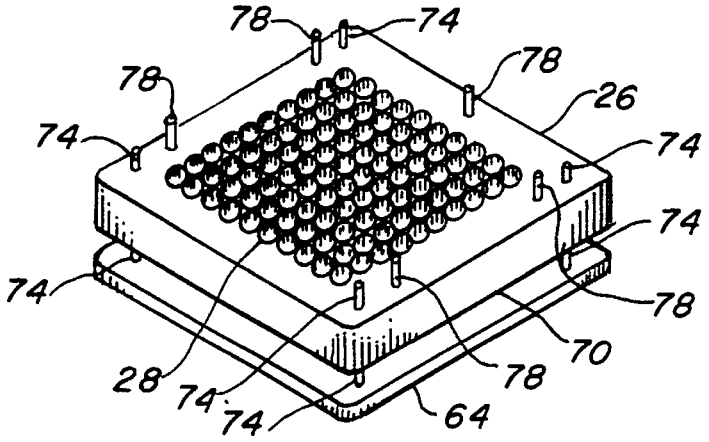
FIG. 1 is a partial isometric view of the ampule holder in the preferred embodiment.
Figure 2:
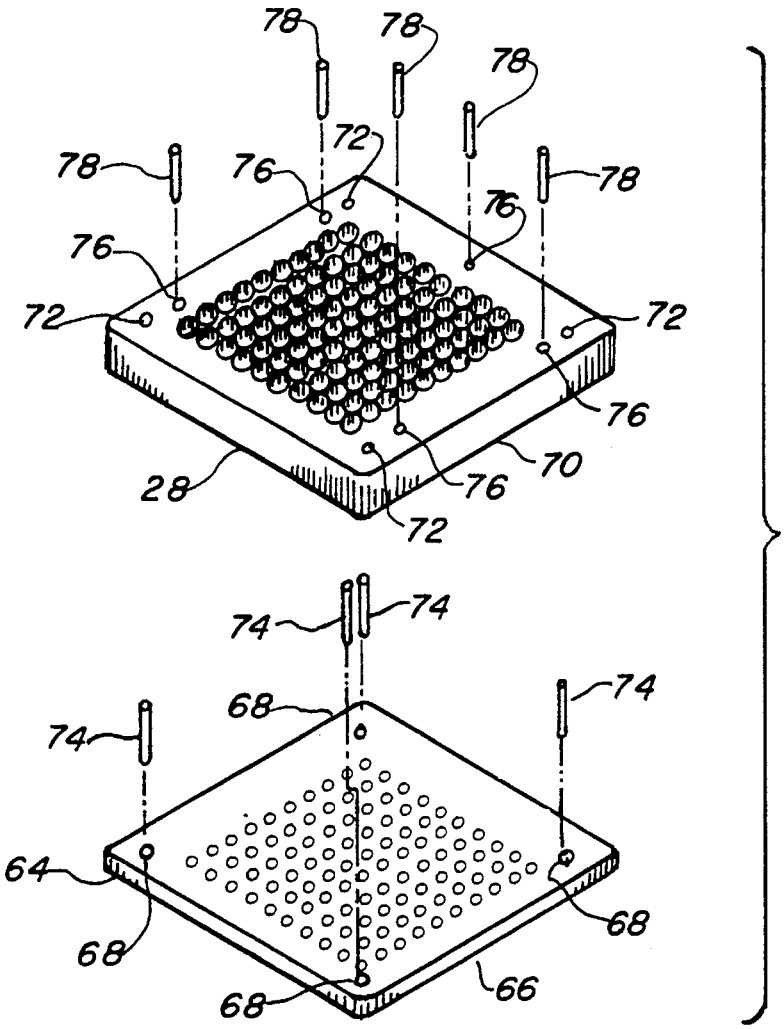
FIG. 2 is an exploded partial isometric view of the ampule holder.

The specific apparatus required to accomplish this method is illustrated in FIGS. 1 through 7 and consists of holder means in the form of the previously mentioned ampule holder 26, illustrated by itself in FIGS. 1 and 2. The holder 26 has a base 64 containing a number of drain holes 66 in alignment with the forementioned bores 28. These drain holes 66 have a diameter smaller than the ampules 22, such that liquid may drain through, but the ampule 22 will be obstructed. The base 64, further includes a pillar hole 68 near each outside corner, as illustrated in the exploded FIG. 2.

The holder 26 also includes a body 70, shown best in FIG. 2, that contains the bores 28. These bores are just slightly larger than the ampules 22, permitting a slip fit therebetween. The body 70 also contains a pillar hole 72 near each outside corner in direct alignment with the base pillar holes 68. A pillar 74 is pressed into each base pillar hole 68 and mating holder pillar hole 72, and a space is left between the base 64 and body 70 for drainage.

The body 70 further contains a plurality of keeper holes 76 positioned near an outside edge, as shown best in the exploded view of FIG. 2. These keeper holes 76 may be any number, however, five have proven optimum, as shown, and the holes preferably do not penetrate completely through the body 70, instead about two-thirds of its depth. A keeper post 78 is pressed into each keeper hole 76 and the post extends upwardly from the top surface of the body 70. These upstanding posts 78 are illustrated installed in FIG. 1 and form indexing means for the shear plate 40 on the holder 26.

The base 64 and body 70 are thermoplastic in the form of polycarbonate, acrylic, polyethylene, polystyrene, polyvinyl chloride, with polypropylene being preferred. The pillars 74 and posts 78 are metallic, with stainless steel being the preferred material for their construction. While the favored materials are thermoplastic and metal, other forms and substances may be used with equal ease.

Shearing means in the form of a shear plate 40 is disposed directly on top of the upright ampules 22 in direct contact with each ampule neck 30. As previously described, the shear plate 40 contains a plurality of neck receiving holes 42, each in alignment with the drain holes 66 in the base and bores 28 in the holder body. These neck receiving holes 42 are slightly larger than the ampule necks 30, allowing a close tolerance clearance fit. The shear plate 40 further contains keeper post clearance holes 80 in alignment with the keeper posts 78 in the holder body 70. These clearance holes 80 are much larger than the outside diameter of the posts 78, permitting the shear plate 40 to slide horizontally on top of the body 70 sufficiently to press against and shear off the ampule necks 30 when struck. These clearance holes 80 are preferably round, however, slots may function equally as well. The shear plate 40 is of the same material as the body 70 and base 64.

Figure 5:
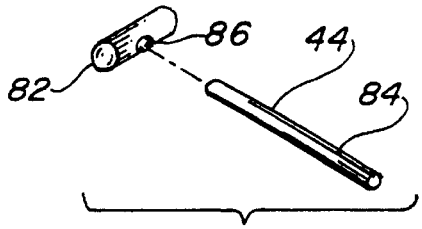
FIG. 5 is a partial isometric exploded view of the mallet completely removed from the invention for clarity.
Figure 4:
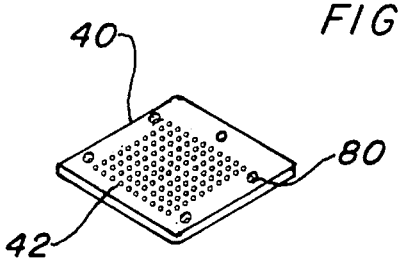
FIG. 4 is a partial isometric view of the shear plate completely removed from the invention for clarity.

Striking means in the form of a mallet 44 impacts the shearing means, or shear plate 40, breaking the ampule necks 30, as previously described. This mallet 44 is shown in FIGS. 5 and 16. The mallet 44 consists of a head 82 and a handle 84. The head 82 has an opening 86 that almost, but not quite, penetrates through, into which the handle 84 is pressed. The head 82 is symmetrical having a striking surface on each end. The mallet 44 is of a thermoplastic material, preferably the same as the holder base 64 and body 70.

Debris containing means takes the form of a tray 34 that provides a flat surface upon which the broken ampule necks 30 may be collected. This tray 34 has a flat bottom 48 and raised sides 88. The tray bottom 48 is of a rigid thermoplastic material, preferably of the same nature as previously utilized and the raised sides 88 are of either thermoplastic or metal. The metal may be ferrous, such as stainless steel or plated carbon steel, however, aluminum is preferred. In any event, four structural angles are utilized, as shown in the exploded view of FIG. 7. The side angles 88 have one leg contiguous with the bottom 48 positioned outwardly toward the edge of the tray bottom 48. The other angular leg extends upwardly forming the outer barrier, or lip of the tray. Three of the four structural angle sides are attached to the bottom 48 with stainless steel threaded fasteners 90, and the fourth is removable having stainless steel studs 92 protruding downwardly from the side angle leg 88 interfacing with slip fit holes in the tray bottom. Four synthetic rubber resilient bumpers 94 extend downwardly from the flat bottom 48 and are affixed upon selected threaded fasteners forming mounting feet for the tray.

Figure 6:
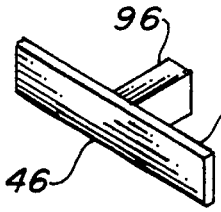
FIG. 6 is a partial isometric view of the sweep completely removed from the invention for clarity.
Figure 7:
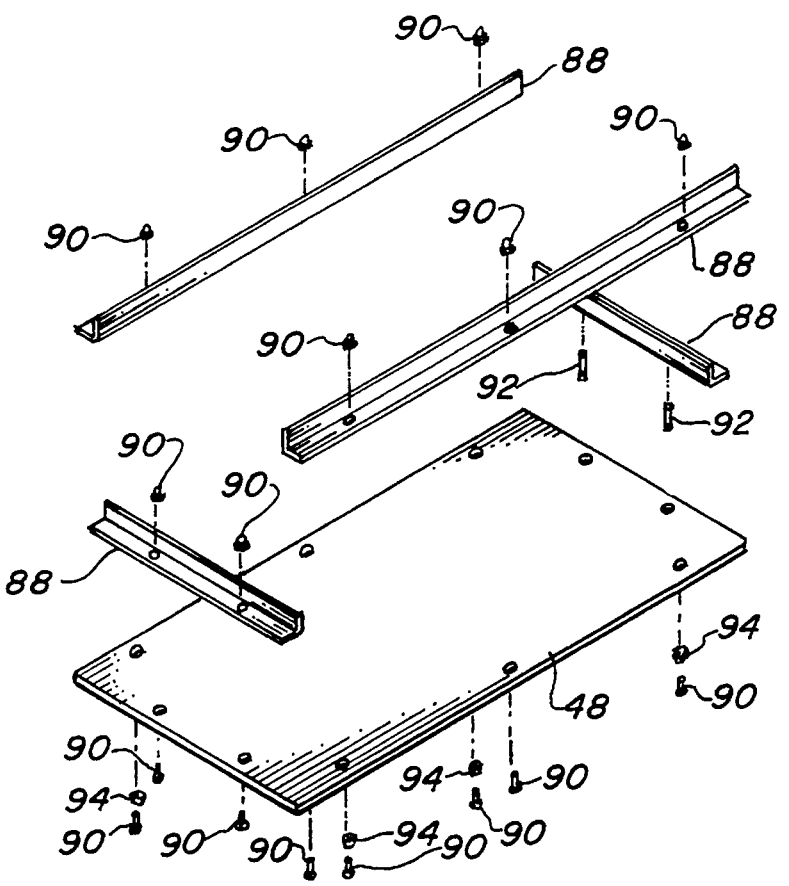
FIG. 7 is a partial isometric exploded view of the tray completely removed from the invention for clarity.

Debris removing means, namely a T-shaped sweep 46, is slideably disposed upon the tray 34 for sweeping the broken ampule necks 30 to a collecting point for disposal. The sweep 46 further provides a rest or stop for the holder 26 when the shear plate 40 is hit with the mallet 44. The sweep 46 is the same height or slightly lower than the holder 26 permitting the shear plate 40 to slide over the top when they are resting on the tray bottom 48 and the ampule necks 30 are sheared off. FIGS. 3, 15 16 and 17 illustrate the sweep in the tray 34 with FIG. 6 showing it by itself and FIG. 19 clearing off the debris from the tray bottom 48. The sweep 46 consists of a spacer block 96 bonded to a blade 98. The spacer block is wide enough to provide a solid stop for the holder 26 and the blade 98 is narrow enough to fit slideably between the raised sides 88 of the tray 34. The spacer block 96 and blade 98 are made of thermoplastic with polypropylene preferred.

While the method and apparatus above described for the preferred embodiment is directed to 1 milliliter ampules shipped in a container of 100 pieces and the syringe is the 3 milliliter size, any size and medication may be easily substituted and is anticipated to cover any combination thereof.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A method of simultaneously breaking a plurality of medication containing ampules and transferring the medication to a plurality of syringes under aseptic conditions comprising the steps of:

cutting an inverted shipping container full of ampules in half in an ante-room and removing the cut half exposing extending ampule bottoms, enclosing the exposed ampules with a holder that has been turned upside down, inverting the holder and ampules together removing and discarding the remaining shipping container half, cleaning the ampules within the holder with alcohol under pressure to remove cardboard dust, tapping down medication from the ampule necks to prevent loss, placing the ampule containing holder on a tray under a clean room hood, positioning a shear plate having a plurality of neck receiving holes over the ampule necks, tapping the shear plate with a mallet breaking all of the ampule necks simultaneously, removing the shear plate leaving the ampule necks on the tray, transferring medication from each ampule with a filtered needle to a sterile container, filling syringes with medication from the sterile container, and then sweeping broken ampule necks and debris into a biohazard container.

2. An ampule breaking apparatus for simultaneously breaking the necks of a plurality of medication containing ampules comprising:

holder means retaining a plurality of ampules in an upright position, shearing means disposed upon the upright ampules in direct contact with each ampule neck, striking means impacting the shearing means such that all of the ampule necks break off simultaneously, debris containing means contiguous with the holder means forming a flat surface upon which the broken ampule necks may collect, and debris removing means slideably disposed upon the containing means sweeping the broken ampule necks to a collecting point for disposal thereof.

3. An ampule breaking apparatus for simultaneously breaking the necks of a plurality of medication containing ampules comprising:

an ampule holder, having a plurality of bores therein in the same relative position as an ampule shipping container, and an upright ampule occupying each bore, also a plurality of upstanding keeper posts positioned on top of the holder near an outside edge, a shear plate, having neck receiving holes, riding over the ampule necks slideably disposed upon the keeper posts, a mallet for striking the shear plate and breaking off the ampule necks simultaneously, a tray having a flat bottom and raised sides for receiving the ampule holder and collecting the ampule necks when broken by the mallet striking the shear plate, and a T-shaped sweep slideably positioned within the tray on the bottom permitting the holder to rest thereupon when the shear plate is hit, also providing a blade to clear away broken necks and debris created by simultaneously opening the enclosed ampules.

4. The ampule breaking apparatus as recited in claim 3 wherein said ampule holder further comprises;

a base having a plurality of drain holes therethrough in alignment with the bores, having a diameter small enough that the ampules will not pass through, and said base having a base pillar hole near each outside corner, a body having the holder bores larger than the ampules permitting a slip fit therebetween, and said body having a body pillar hole near each outside corner in direct alignment with the base pillar hole, also a plurality of keeper post bores for tightly receiving the keeper posts, and a pillar pressed into each mating base and body pillar hole providing a connection between the base and the body with a space between for drainage and a surface on top to rest the shear plate.

5. The ampule breaking apparatus as recited in claim 4 wherein said base and body are thermoplastic and said pillars and keeper posts are stainless steel.

6. The ampule breaking apparatus as recited in claim 3 further comprising said shear plate neck receiving holes are large enough to create a clearance fit between the ampule necks and the holes, and said shear plate further having a plurality of keeper post clearance holes in alignment with the keeper posts of a diameter large enough to permit the shear plate to move and press against the ampule necks and break off when the shear plate is struck a blow by a mallet.

7. The ampule breaking apparatus as recited in claim 3 wherein said shear plate is thermoplastic.

8. The ampule breaking apparatus as recited in claim 3 wherein said mallet further comprises a head having an opening therein and a handle pressed into the opening, the head further having a striking surface on each end.

9. The ampule breaking apparatus as recited in claim 3 wherein said mallet is thermoplastic.

10. The ampule breaking apparatus as recited in claim 3 wherein said tray raised sides further comprises four angles contiguous with the flat bottom, each having a pair of right angular extending legs, one positioned outwardly touching the bottom, and the other extending upwardly, the legs further attached to the bottom, three with threaded fasteners and a fourth removable having studs protruding downwardly from the outwardly extending leg interfacing with slip fit holes in the tray bottom.

11. The ampule breaking apparatus as recited in claim 10 further comprising a plurality of resilient bumpers disposed downwardly from the flat bottom affixed upon selected threaded fasteners forming mounting feet for the tray.

12. The ampule breaking apparatus as recited in claim 11 wherein the flat bottom is thermoplastic, the threaded fasteners and studs are stainless steel, and the bumpers are synthetic rubber.

13. The ampule breaking apparatus as recited in claim 3 wherein said sweep further comprises a spacer block and a blade bonded together, with the spacer block wide enough to provide a stop for the holder and the blade narrow enough to fit slideably between the tray raised sides, with the sweep substantially the same height as the holder.

14. The ampule breaking apparatus as recited in claim 13 wherein the spacer block and blade are thermoplastic.

* * * * *